US008642132B2

(12) United States Patent
Miyamoto et al.

(10) Patent No.: US 8,642,132 B2
(45) Date of Patent: Feb. 4, 2014

(54) METHOD OF FORMING CARBON PARTICLE-CONTAINING FILM, HEAT TRANSFER MEMBER, POWER MODULE, AND VEHICLE INVERTER

(75) Inventors: Noritaka Miyamoto, Toyota (JP); Yoshihiko Tsuzuki, Toyota (JP); Tomoko Kozaki, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 175 days.

(21) Appl. No.: 12/778,455

(22) Filed: May 12, 2010

(65) Prior Publication Data

US 2010/0296253 A1 Nov. 25, 2010

(30) Foreign Application Priority Data

May 19, 2009 (JP) ..... 2009-121031

(51) Int. Cl.
*C23C 4/04* (2006.01)
*B05D 1/10* (2006.01)

(52) U.S. Cl.
USPC ..... 427/455; 427/422; 427/427; 427/450

(58) Field of Classification Search
USPC ..... 427/421.1, 422, 427, 446, 450, 452, 427/455, 456
See application file for complete search history.

(56) References Cited

U.S. PATENT DOCUMENTS

| | | | | |
|---|---|---|---|---|
| 6,218,035 | B1 * | 4/2001 | Fuglevand et al. | 429/480 |
| 2003/0211335 | A1 * | 11/2003 | McNulty et al. | 428/432 |
| 2004/0234695 | A1 * | 11/2004 | Trahan et al. | 427/304 |
| 2006/0111005 | A1 * | 5/2006 | Geohegan et al. | 442/340 |
| 2007/0140946 | A1 * | 6/2007 | Gabriel et al. | 423/447.1 |
| 2008/0090071 | A1 * | 4/2008 | Valle et al. | 428/336 |
| 2008/0241543 | A1 * | 10/2008 | Kempf et al. | 428/403 |
| 2008/0248288 | A1 * | 10/2008 | Boardman | 428/328 |

FOREIGN PATENT DOCUMENTS

| | | | |
|---|---|---|---|
| DE | 49872 | | 5/1966 |
| DE | 861288 | | 2/1986 |
| JP | 02504045 | | 11/1989 |
| JP | 10-168502 | A | 6/1998 |
| JP | 2004-232035 | A | 8/2004 |
| JP | 2005-002446 | A | 1/2005 |
| JP | 2006-045596 | A | 2/2006 |
| JP | 2006-164884 | A | 6/2006 |
| JP | 2006-298687 | A | 11/2006 |
| JP | 2007-522346 | A | 8/2007 |
| JP | 2008-095176 | A | 4/2008 |
| JP | 2009-001873 | A | 1/2009 |
| WO | 89/10423 | | 11/1989 |
| WO | WO 2005078150 | A1 | 8/2005 |

OTHER PUBLICATIONS

Japanese Office Action in Japanese Application No. 2009-121031 dated Aug. 30, 2011.
Japanese Office Action in Japanese Application No. 2009-121031 dated May 2, 2012.
German Office Action issued in German Application No. 102012017009.7 on Jun. 12, 2012.

* cited by examiner

*Primary Examiner* — Alexander Weddle
(74) *Attorney, Agent, or Firm* — Sughrue Mion, PLLC

(57) ABSTRACT

A method of depositing a carbon particle-containing film that contains carbon particles includes: manufacturing film deposition slurry by mixing liquid into film deposition powder that contains carbon powder formed of the carbon particles; and depositing the carbon particle-containing film by spraying the film deposition slurry to a surface of a base material so that the liquid is vaporized.

5 Claims, 6 Drawing Sheets

METHOD OF FORMING CARBON PARTICLE-CONTAINING FILM, HEAT TRANSFER MEMBER, POWER MODULE, AND VEHICLE INVERTER

INCORPORATION BY REFERENCE

The disclosure of Japanese Patent Application No. 2009-121031 filed on May 19, 2009 including the specification, drawings and abstract is incorporated herein by reference in its entirety.

BACKGROUND OF THE INVENTION

1. Field of the Invention

The invention relates to a method of forming a carbon particle-containing film, which forms a film containing the composition of metal powder, a heat transfer member manufactured by the method, a power module, and a vehicle inverter and, more particularly, to a method of forming a carbon particle-containing film, which allows low-cost and easy film deposition, a heat transfer member, a power module, and a vehicle inverter.

2. Description of the Related Art

A power module (module) 90 used for a vehicle inverter, or the like, according to a related art is formed of electronic components shown in FIG. 9. Specifically, the power module 90 at least includes a power device 91, an insulating member (aluminum nitride material) 93, and a heat sink member 94. The power device 91 is formed of a silicon device. The insulating member 93 is made of aluminum nitride to which the power device 91 is fixed via a solder layer 92. The heat sink member 94 is made of aluminum. Furthermore, a buffer member 95 made of copper-molybdenum (Cu—Mo) or aluminum-silicon carbide (Al—SiC) is arranged between the insulating member 93 and the heat sink member 94. The buffer member 95 is used to not only transfer heat generated from the power device 91 to the heat sink member 94 to radiate the heat but also buffers a difference in thermal expansion between the insulating member 93 and the heat sink member 94. The buffer member 95 is fixed to the insulating member 93 by the solder layer 96, and is fixed to the heat sink member 94 by silicon grease 97. In this way, the buffer member 95 together with the heat sink member 94 constitutes a heat transfer member for radiating heat from the power device 91.

In order to improve radiation of heat from the power device 91, Japanese Patent Application Publication No. 2006-298687 (JP-A-2006-298687), for example, describes a method of making a heat transfer member contain carbon particles. When the above method is used to manufacture the buffer member 95, carbon particles are initially baked to be networked to thereby manufacture a porous sintered compact, and then metal is impregnated into the porous sintered compact.

However, even when the above buffer member is used, in the power module 90, the thermal conductivity of the silicon grease 97 that fixes the buffer member 95 is lower than those of the other members, so the silicon grease 97 becomes an obstacle to transferring heat of the power device 91 to the heat sink member 94.

To work around the above problem, for example, powder containing carbon particles may be directly sprayed to the surface of the heat sink member 94 to form the buffer member without using the silicon grease 97. However, during film deposition, when carbon particles are tried to be sprayed while metal is melted, the carbon particles are gasified by oxidation reaction and burned, so it is difficult to make the film contain carbon particles.

In view of the above, Japanese Patent Application Publication No. 2004-232035 (JP-A-2004-232035), for example, describes a method of forming a film as a buffer member by thermally spraying powder, formed of powder particles that graphite particles (carbon particles) are coated with metal films, to a base material. With the above film deposition method, only metal films are melted and then thermally sprayed, so it is possible to make a film contain carbon particles.

However, when the above film deposition method is used to form a film, it is necessary to manufacture carbon particles, of which the surfaces are plated with metal, and powder that contains carbon particles treated to be covered with metal during granulation. Then, if parts of surfaces of carbon particles are exposed, the exposed surfaces are caused to perform oxidation reaction during thermal spraying, so carbon particles may be possibly burned. In addition, it is desirable that the surfaces of carbon particles are completely coated with metal. However, powder made of particles manufactured by the above described method is considerably expensive, and it is not realistic to apply the powder to automobile components, or the like.

SUMMARY OF THE INVENTION

The invention provides a method of forming a carbon particle-containing film, which allows a carbon particle-containing film to be manufactured at lower cost, a heat transfer member, a power module provided with the heat transfer member, and a vehicle inverter provided with the power module.

An aspect of the invention relates to a method of depositing a carbon particle-containing film that contains carbon particles. The method includes: manufacturing film deposition slurry by mixing liquid into film deposition powder that contains carbon powder formed of the carbon particles; and depositing the carbon particle-containing film by spraying the film deposition slurry to a surface of a base material so that the liquid is vaporized.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
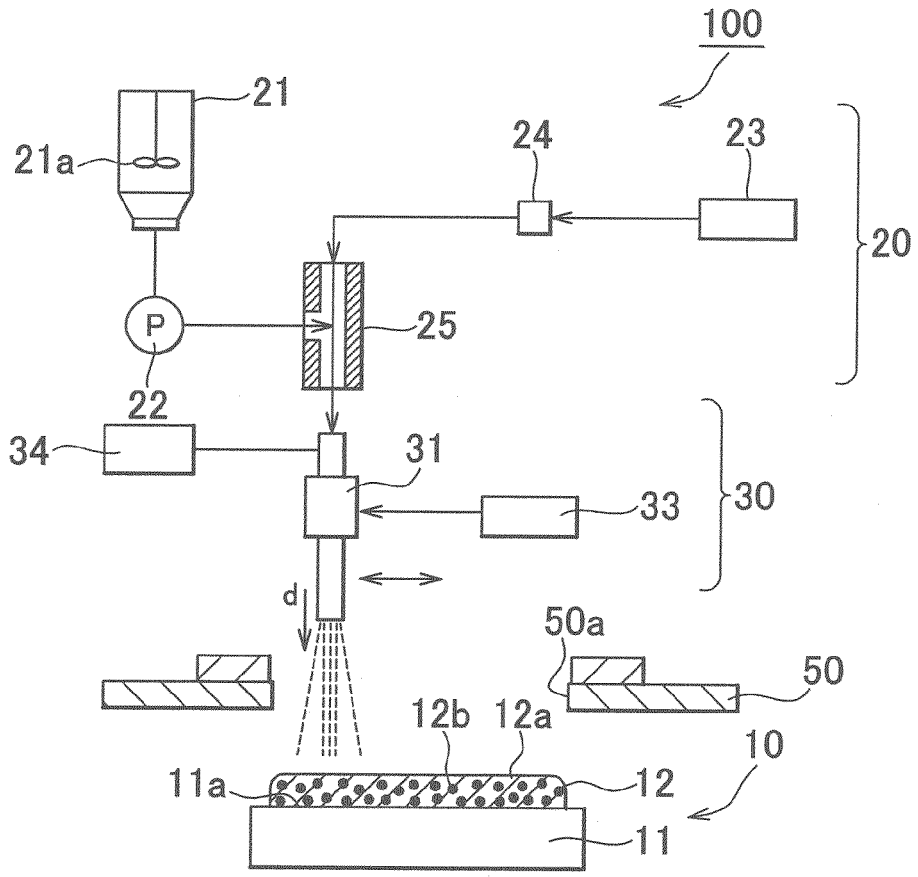
FIG. 1 is a schematic view that illustrates a method of forming a carbon particle-containing film (method of manufacturing a heat transfer member) according to an embodiment.

Hereinafter, a method of forming a carbon particle-containing film according to an embodiment of the invention will be described in detail with reference to the accompanying drawings. FIG. 1 is a schematic view that illustrates a method of forming a carbon particle-containing film (method of manufacturing a heat transfer member) according to the present embodiment.

A heat transfer member 10 according to the present embodiment is obtained in such a manner that film deposition powder containing carbon particles and metal particles are sprayed to the surface of a base material 11 to form a metal film containing carbon particles (carbon particle-containing film) 12. The heat transfer member 10 may be manufactured using a film deposition system 100 shown in FIG. 1.

The film deposition system 100 includes a slurry production unit 20 and a spraying unit 30. The slurry production unit 20 mixes the film deposition powder with liquid to produce (manufacture) film deposition slurry. The spraying unit 30 thermally sprays the film deposition slurry produced by the slurry production unit 20 to the base material 11. The slurry production unit 20 includes a slurry hopper 21, a slurry pump 22, a carrier gas supply source 23, a pressure regulator valve 24 and a mixing unit 25 as a minimum configuration. Here, the film deposition slurry is a muddy or pasty mixture, and means fluid that particles of film deposition powder are slurried in liquid. The powder means an aggregation of particles. For example, carbon powder means an aggregation of carbon particles, and metal powder means an aggregation of metal particles.

In the present embodiment, the slurry hopper 21 has an agitator 21*a* inside, and the slurry pump 22 is connected to the slurry hopper 21. The slurry pump 22 is a typical pump, such as a screw pump and a tube pump, that is used when film deposition powder is transported by film deposition slurry. The slurry pump 22 is connected to the mixing unit 25 via a pipe.

The carrier gas supply source 23 supplies compressed gas to the mixing unit 25, and is connected to the mixing unit 25 via the pressure regulator valve 24. The pressure regulator valve 24 regulates the pressure of the compressed gas. In addition, the carrier gas supply source 23 may be, for example, a cylinder filled with air, inert gas, or the like, and a compressor that compresses air. The mixing unit 25 mixes film deposition slurry with carrier gas, and is connected to a thermal spraying gun 31 so that film deposition slurry is transportable to the thermal spraying gun 31 by carrier gas. In this manner, the film deposition slurry produced by the slurry production unit 20 may be transported to the spraying unit 30.

The spraying unit 30 is a known high velocity flame spraying system. The spraying unit 30 includes the thermal spraying gun (HVOF thermal spraying gun) 31, an inflammable gas supply source 33 and a gun actuator 34 as a minimum configuration. The thermal spraying gun 31 is configured so that inflammable gas (for example, oxygen or hydrocarbon gas) is supplied from the inflammable gas supply source 33. The inflammable gas supplied to the thermal spraying gun is burned in a combustion chamber (not shown), and a continuous combustion flame is throttled by a nozzle (not shown) to generate a high velocity jet flame.

Furthermore, the thermal spraying gun 31 is configured to transport film deposition slurry from the slurry production unit 20 to the jet flame generated. By so doing, the thermal spraying gun 31 is able to heat film deposition slurry to thermally spray the film deposition slurry to the surface of the base material 11. In addition, the thermal spraying gun 31 is connected to the gun actuator 34. By driving the gun actuator 34, the thermal spraying gun 31 is movable in a predetermined route.

The thus configured film deposition system 100 is used to manufacture the heat transfer member 10 by the following method. In the present embodiment, first, the base material 11 is placed below a masking plate 50 having a rectangular opening 50*a*. Note that the opening 50*a* is formed to have an area that corresponds to a rectangular predetermined deposition region on a surface 11*a* of the base material 11. Then, the base material 11 is placed so that the opening 50*a* coincides with the predetermined deposition region of the base material 11 in a spraying direction d.

Subsequently, copper powder (or aluminum powder) that serves as metal powder made of metal particles and carbon powder (for example, graphite powder) made of carbon particles are mixed at a predetermined ratio to prepare film deposition powder, and then the film deposition powder and water (or alcohol) are put into the slurry hopper 21. Here, the prepared water or alcohol is mixed with film deposition powder to manufacture film deposition slurry, and is liquid that may be vaporized when sprayed to the surface of the base material 11.

Then, the film deposition powder and water that are put in the slurry hopper 21 are agitated to be kneaded by the agitator 21*a* to manufacture film deposition slurry. The manufactured film deposition slurry is supplied under its own weight to the slurry pump 22 connected to the slurry hopper 21 via a pipe. The film deposition slurry supplied to the slurry pump 22 is transported to the mixing unit 25 by the slurry pump 22.

In the mixing unit 25, the film deposition slurry transported from the slurry pump 22 is mixed with carrier gas that is supplied from the carrier gas supply source 23 and of which the pressure is regulated via the pressure regulator valve 24. The film deposition slurry discharged from the mixing unit 25 is atomized by the carrier gas, and is supplied to the spraying unit 30.

After that, inflammable gas is supplied to the spraying unit, and is burned to generate a jet flame. The film deposition slurry is supplied to a gun nozzle (not shown) of the thermal spraying gun 31 and is carried by the jet flame to spray the film deposition slurry to the surface of the base material 11.

At this time, in the film deposition slurry, the copper powder is heated by the jet flame to melt, whereas the carbon powder is also heated by the jet flame; however, water adheres around (coats) the carbon particles of the carbon powder, so the carbon particles are hard to be burned by oxidation reaction and reach the surface of the base material 11. Water is vaporized by the jet flame (flame temperature of 1500° C. to 2000° C.) at a temperature at which the film deposition slurry has reached the surface of the base material (spraying temperature at which the film deposition slurry is sprayed to the surface of the base material 11), so no water remains on the surface of the base material. In order for liquid not to remain in the film, liquid contained in the film deposition slurry is selected on the condition that the liquid is at least vaporized at the above temperature. Here, when metal powder, such as copper powder, is used, the spraying temperature of the surface of the base material 11 is a thermal spraying temperature of the metal powder.

Then, the thermal spraying gun 31 is moved linearly in a predetermined moving direction, and then the thermal spraying gun 31 is moved by the amount of a pitch at a right angle to the moving direction with respect to the base material 11. A series of these movements are repeated to spray the melted copper and carbon particles (film deposition slurry heated to the spraying temperature) to the predetermined deposition region of the base material 11 to thereby deposit a carbon particle-containing film. By so doing, the carbon particle-containing film contains carbon particles 12*b*. These carbon particles 12*b* are bound by copper 12*a*.

Figure 2:
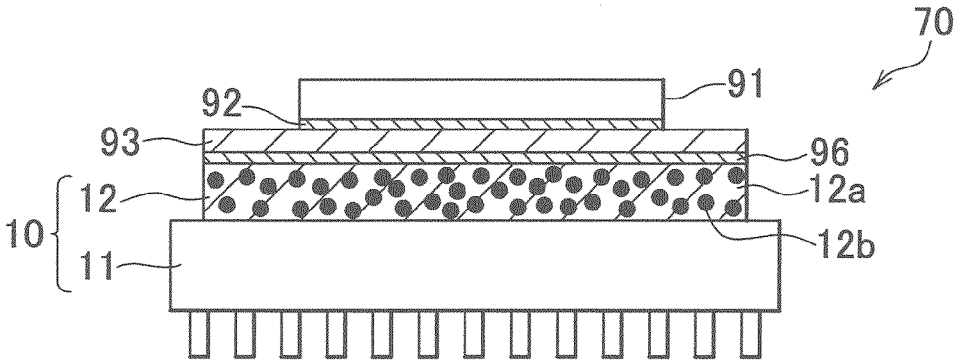
FIG. 2 is a view that illustrates a power module to which the heat transfer member manufactured according to the present embodiment is applied.

FIG. 2 is a view that illustrates a power module to which the heat transfer member manufactured according to the present embodiment is applied. Note that like reference numerals denote similar components to the components that constitute the power module 90 illustrated in FIG. 9, and the detailed description thereof is omitted.

As shown in FIG. 2, the power module 70 includes the heat transfer member 10 manufactured by the above described method. The aluminum base material (heat sink member) 11 that constitutes the heat transfer member is included in a heat sink member that constitutes the power module 70. Furthermore, the carbon particle-containing film 12 contains the carbon particles 12*b* and constitutes the heat transfer member 10. The carbon particle-containing film 12 is arranged as a buffer member between the aluminum nitride insulating member (aluminum nitride material) 93 and the heat sink member 11. The power device 91 is mounted on the insulating member 93.

In this way, the carbon particle-containing film 12 of the heat transfer member is arranged between the insulating member 93 and the heat sink member (base material) 11 that constitute the power module 70. Thus, the power module 70 is not required to use silicon grease for blocking thermal conduction on the surface of the heat sink member 11. The power module 70 is able to efficiently transfer heat from the heated power device 91 by the heat sink member 11 and radiate heat of the power device 91.

In addition, the carbon particle-containing film 12 contains the carbon particles 12*b*, so it is possible to buffer a difference in thermal expansion between the aluminum nitride material 93 and the heat sink member 11, and it is also possible to improve thermal conductivity. As a result, it is possible to obtain the reliable power module 70 that prevents peeling or cracks of the film to improve thermal fatigue strength against heat cycle.

Figure 3:
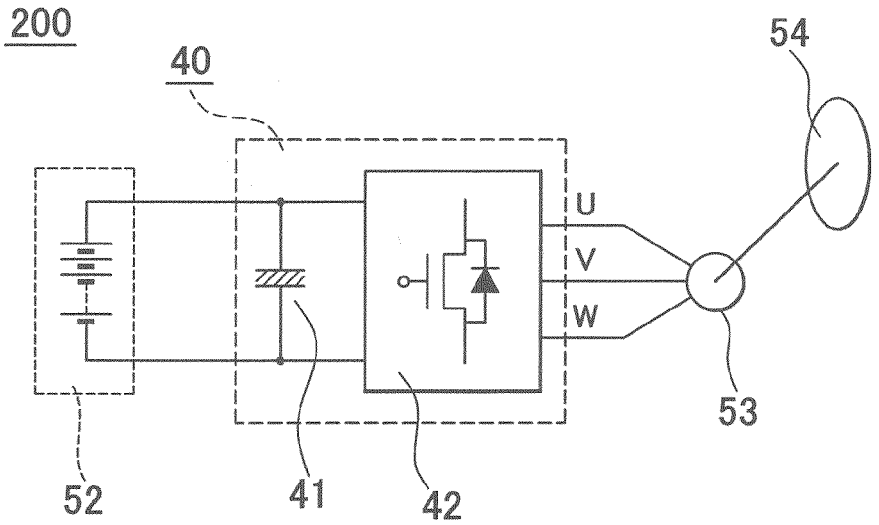
FIG. 3 is a schematic view of a vehicle inverter equipped with the power module according to the present embodiment and a vehicle equipped with the vehicle inverter.

FIG. 3 is a schematic view of a vehicle inverter 42 equipped with the power module according to the present embodiment and a vehicle 200 equipped with the vehicle inverter. In FIG. 3, the vehicle inverter 40 according to the present embodiment is an electric power conversion system that is used in a hybrid vehicle that uses an engine and a motor, an electric vehicle, or the like, and that converts direct current into alternating current to supply electric power to an alternating-current load, such as an induction motor. The vehicle inverter 42 includes the power module according to the above described embodiment, a large-capacitance capacitor 41, or the like, as a minimum configuration. Then, a direct-current power supply 52, such as a battery, is connected to the vehicle inverter 42, and three UVW phase alternating currents output from the vehicle inverter 42 are, for example, supplied to an induction motor 53 to drive the induction motor 53. In addition, as the induction motor 53 drives, a wheel 54 of the vehicle 200 rotates to make it possible to drive the vehicle 200. Note that the vehicle inverter 42 is not limited to the illustrated example; the vehicle inverter 42 may be any form as long as it has the function of an inverter.

In the thus configured vehicle inverter 40, for example, when the power device 91 of the power module 70 shown in FIG. 2 heats up to high temperatures during operation, heat generated from the power device 91 is transferred through the solder layer 92 to the aluminum nitride material (insulating member) 93 on which the power device 91 is mounted, and, furthermore, the heat is transferred through the solder layer 96 to the carbon particle-containing film 12 and is radiated from the heat sink member (base material) 11 that serves as a heat radiation material. At this time, a film that contains carbon particles is used as the carbon particle-containing film 12. Thus, the particle-containing film 12 operates as a buffer material that buffers a difference in thermal expansion between the aluminum nitride material 93 and the heat sink member 11, and is able to desirably transfer heat from the power device 91 to the heat sink member. In this way, it is possible to obtain the reliable vehicle inverter 40 that suppresses occurrence of peeling or cracks of these components. Therefore, it is possible to improve the safety of the vehicle 200.

The present embodiment will be described using the following examples. In order to manufacture a heat transfer member according to Example 1, first, aluminum alloy (JIS: A3003) having a size of 50 mm×50 mm and a thickness of 5 mm was prepared as a heat sink member (base material), and then a surface of the aluminum alloy, on which a film will be deposited, is subjected to abrasive blasting by 100 μm gray alumina particles.

Subsequently, pure aluminum powder (gas-atomized powder formed of pure aluminum particles having a mean particle diameter of 15 μm) and graphite powder (powder formed of spheroidized graphite particles (carbon particles) having a mean particle diameter of 20 μm) were mixed at a volume ratio of 50 to 30 to manufacture mixed powder as film deposition powder. The film deposition powder was used to perform film deposition according to the above described embodiment.

Specifically, the film deposition powder (mixed powder) was mixed with water having the same volume as that of the film deposition powder, and then the mixture was agitated by the agitator of the slurry hopper for 10 minutes to manufacture film deposition slurry. Oxygen gas and fuel gas (kerosene) were supplied to the HVOF thermal spraying system and burned, and then the film deposition slurry was sprayed by the HVOF thermal spraying gun to the base material under the condition 1 shown in Table 1 to deposit the aluminum film having a thickness of 1.5 mm. Here, a system that is able to transport film deposition slurry from the center of six jets arranged on a circle was employed as the HVOF thermal spraying system.

Furthermore, pure aluminum powder (powder formed of gas-atomized pure aluminum particles having a mean particle diameter of 15 μm was used to perform HVOF thermal spraying to the surface of the film under the condition 1 shown in Table 1 to thereby deposit 0.2 mm aluminum film. The surface of the aluminum film was ground by the thickness range of 0.1 mm to 0.15 mm for finishing.

A DBA material (aluminum nitride material) having a thickness of 0.7 mm was brazed to the finished surface using brazing filler metal (JIS: A4004) heated to 600° C. to thereby manufacture a module (module with no power device).

As in the case of Example 1, a module was manufactured as Example 2. Example 2 differs from Example 1 in that spheroidized graphite powder (powder formed of graphite particles (carbon particles) having a mean particle diameter of 40 μm) was used for graphite powder of the film deposition powder.

As in the case of Example 1, a module was manufactured as Example 3. Example 3 differs from Example 1 in that flaky graphite powder (powder formed of graphite particles (carbon particles) having a mean particle diameter of 50 μm) was used for graphite powder of the film deposition powder.

As in the case of Example 1, a module was manufactured as Example 4. Example 4 differs from Example 1 in that pure copper powder (powder formed of pure copper particles having a mean particle diameter of 16 μm) was used instead of pure aluminum powder of the film deposition powder, pure nickel powder (powder formed of pure nickel particles having a mean particle diameter of 15 μm) was used for film deposition instead of performing film deposition on the deposited surface using pure aluminum powder, and aluminum nitride material was bonded by soldering solder (Sn—Ag—Cu) at a solder reflow temperature of 375° C., instead of brazing.

As in the case of Example 1, a module was manufactured as Comparative example 1. Comparative example 1 differs from Example 1 in that a film was deposited by plasma thermal spraying under the condition 2 shown in Table 1 in a state where film deposition powder was not mixed with water (without manufacturing film deposition slurry) but remained in form of powder.

As in the case of Example 1, a module was manufactured as Comparative example 2. Comparative example 2 differs from Example 1 in that a film was deposited under the condition 1 shown in the following Table 1 in a state where film deposition powder was not mixed with water (without producing film deposition slurry) but remained in form of powder. Furthermore, Comparative example 2 differs from Example 1 in that film deposition was performed on the deposited surface using pure nickel powder (powder formed of pure nickel particles having a mean particle diameter of 15 μm) instead of performing film deposition using pure aluminum powder by HVOF thermal spraying, and aluminum nitride material was bonded by soldering instead of brazing.

TABLE 1

| | Condition 1 (HVOF Thermal Spraying) | Condition 2 (Plasma Thermal Spraying) |
|---|---|---|
| Applied Voltage (V) | — | 60.6 |
| Electric Current (A) | — | 450 |
| Oxygen Pressure (Psi) | 110 | — |
| Kerosene Pressure (Psi) | 100 | — |
| Gun Internal Pressure (Psi) | 65 | — |
| Gun Traveling Speed (m/sec) | 2 | 45 |
| Pitch (mm) | 4 | 4 |
| Thermal Spraying Distance (mm) | 300 | 100 |
| Carrier Gas Flow Rate (L/min) | 15 | 6.5 |
| Plasma Excitation Gas (L/min) | — | 3($H_2$), 70(Ar) |
| Slurry or Powder Transport Speed (g/min) | 150 (No Solvent) | 31 |
| Spraying Temperature (Thermal Spraying Temperature) ° C. | Flame Temperature 1500° C. to 2000° C. Particle Temperature (When Reaching Object Material) 650° C. to 1000° C. | Particle Temperature (When Reaching Object Material) 1000° C. to 1500° C. |

Figure 4:
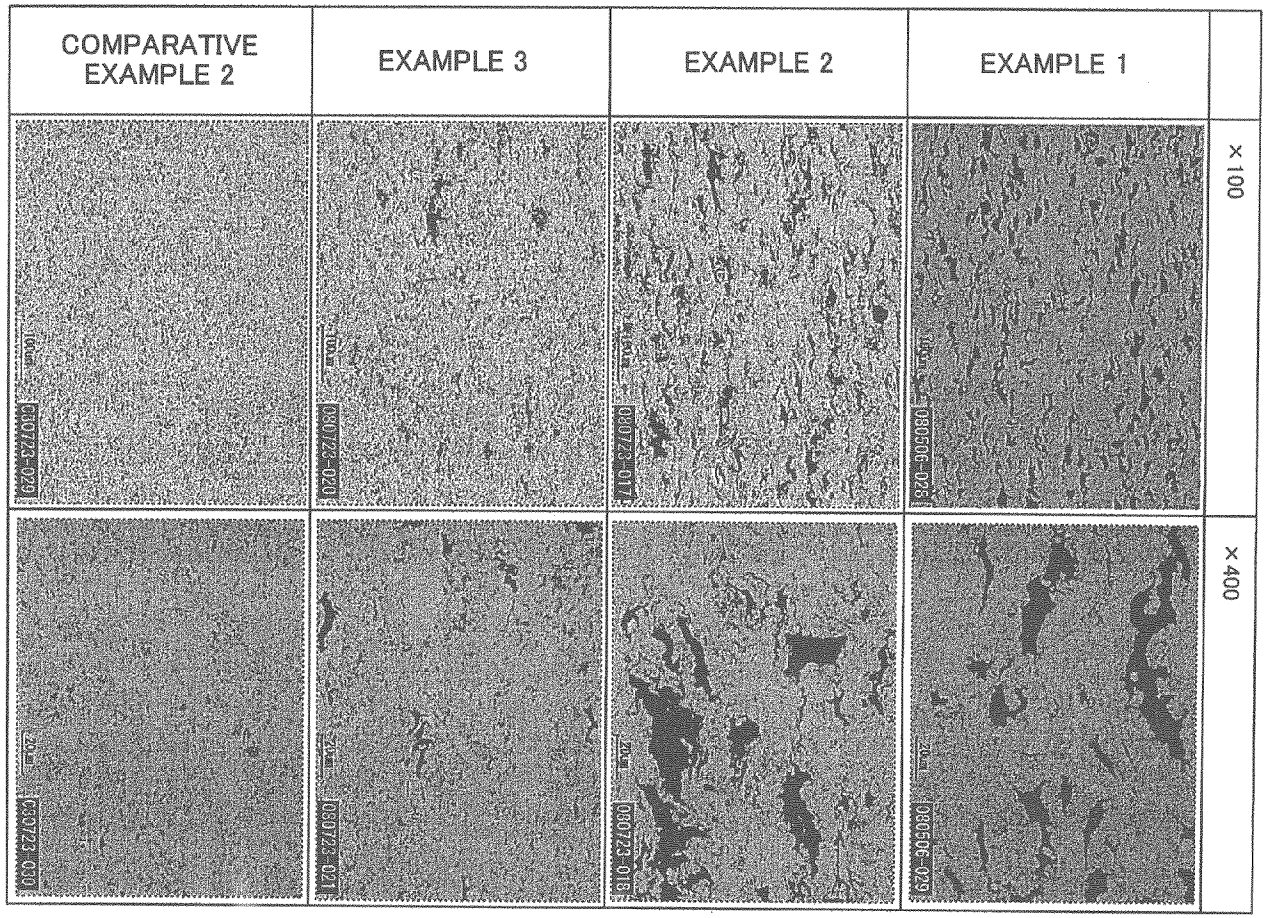
FIG. 4 is photographs of the cross-sections of films of Examples 1, 2 and 3 and Comparative example 2.

Examples 1 to 4 and Comparative examples 1 and 2 were subjected to the following evaluation test. In the stage in which an aluminum film containing the carbon particles was deposited, the cross-section of the film was observed by a microscope. The results are shown in FIG. 4. In addition, the percentage of a black portion was obtained through the view of the microscope at this time, and was regarded as a percentage of graphite area. The results are shown in Table 2.

TABLE 2

| | Example 1 | Example 2 | Example 3 | Comparative Example 1 | Comparative Example 2 |
|---|---|---|---|---|---|
| Percentage of Graphite Area (%) | 14.2 | 13.9 | 3.8 | 0 | 0 |

Figure 5:
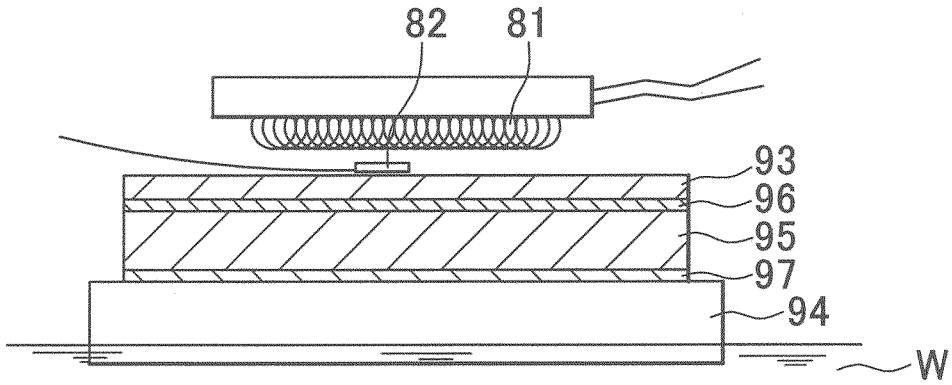
FIG. 5 is a view that illustrates a method of setting an input voltage of a heat transfer wire in heat transfer evaluation.
Figure 9:
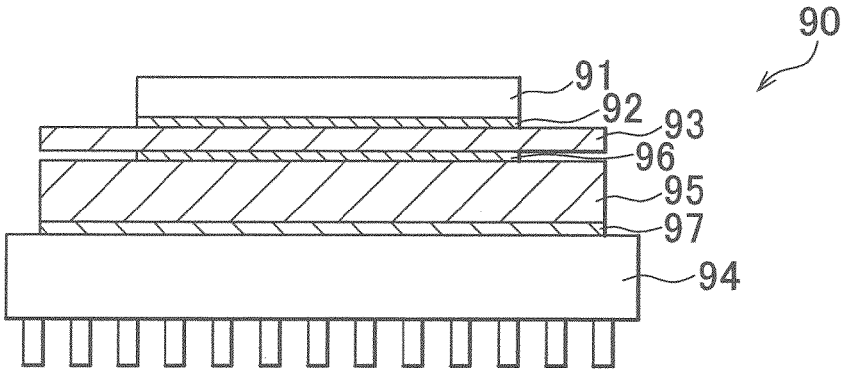
FIG. 9 is a view that illustrates a power module according to a related art.

In order to conduct heat transfer evaluation, a reference module was manufactured as shown in FIG. 5 (and FIG. 9). Specifically, aluminum alloy (JIS: A3003) having a size of 50 mm×50 mm and a thickness of 5 mm was prepared as a heat sink member (base material), Cu—Mo material (Cu—Mo sintered material) having a thickness of 3 mm was stuck by silicon grease, and then aluminum nitride material having a thickness of 0.7 mm was brazed by brazing filler metal heated to 600° C. as in the case of Example 1.

Then, the module was set as follows. As shown in FIG. 5, the surface of the heat sink member 94 was immersed in coolant W, a thermocouple 82 was arranged above the aluminum nitride material 93 in a noncontact manner, and a voltage input to the heat transfer wire 81 was set to be constant so that the temperature of the surface of the aluminum nitride material 93 becomes 160° C. in measurement value of the thermocouple 82 after 10 seconds.

Figure 6:
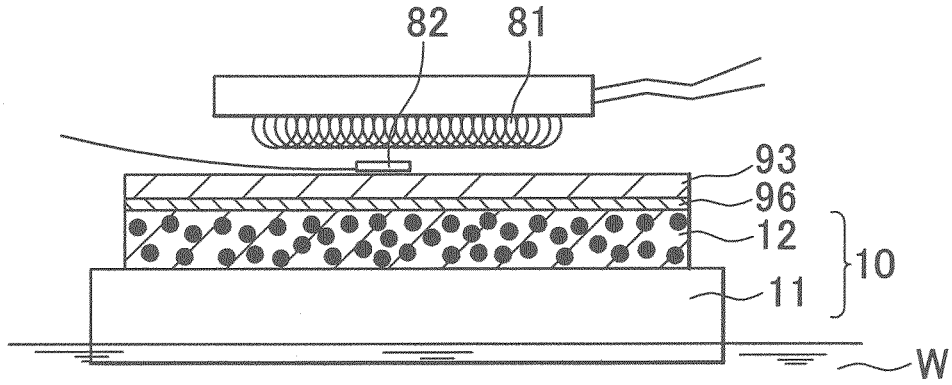
FIG. 6 is a view that illustrates a method for heat transfer evaluation.
Figure 7:
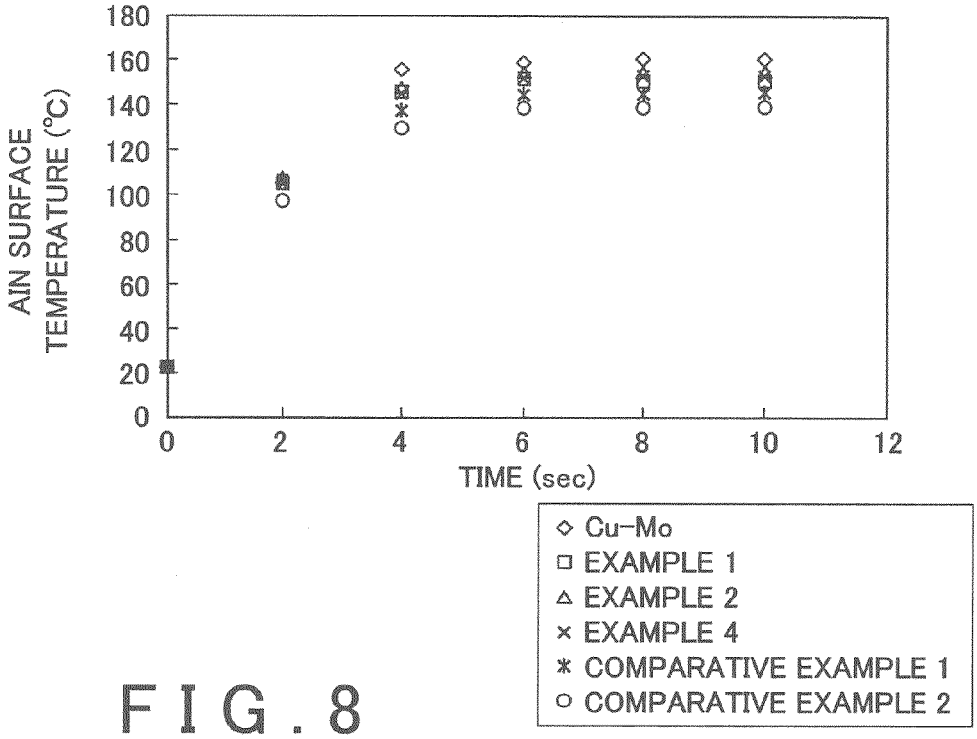
FIG. 7 is a graph of the results of heat transfer evaluation on modules.

Under the condition of the set voltage, as shown in FIG. 6 (drawing that exemplifies the module of Example 1), by means of the same method, the test piece (module) of Example 1 was heated by a heating wire 81, and the surface temperature of the aluminum nitride material 93 (AlN surface temperature) was measured by the thermocouple 82. Note that the results are shown in FIG. 7.

The module manufactured by means of the above method was subjected to 10000 cycles of −20° C.→200° C.→−20° C.→200° C. (heating: 6.5 seconds, cooling: 3.5 seconds) as heat-resistance evaluation as in the case of the heat transfer evaluation shown in FIG. 6. Heating test shown in FIG. 6 was conducted at cycles of 2000, 4000, 6000 and 10000, and then the surface temperature of the aluminum nitride material 93 (AlN surface temperature) was measured. In addition, the module shown in FIG. 5 was also subjected to the same tests.

Figure 8:
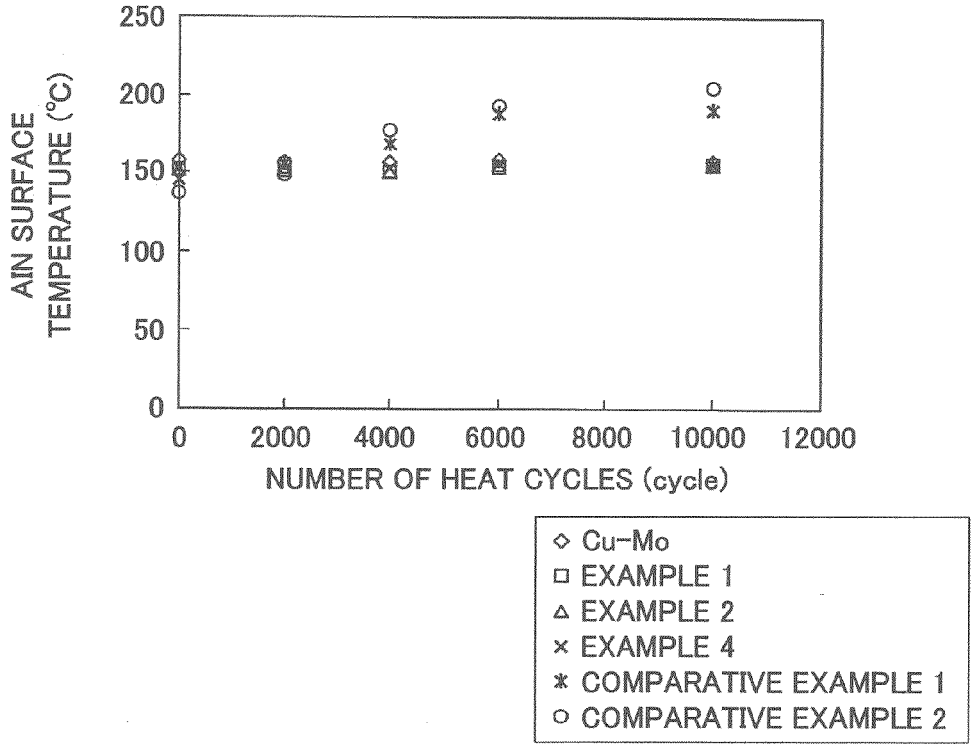
FIG. 8 is a graph of the results of heat-resistance evaluation on modules.

The results including the results for the above module shown in FIG. 5 are shown in FIG. 8 (rhombus Cu—Mo in the graph). In addition, the state of the brazed layer (solder layer) 96 between the aluminum nitride material 93 and the film 12 after being subjected to 10000 cycles was observed. These results are shown in the following Table 3.

TABLE 3

| | State of Brazed Layer or Solder Layer |
|---|---|
| Example 1 | No Abnormality |
| Example 2 | No Abnormality |
| Example 4 | No Abnormality |
| Cu—Mo | No Abnormality |
| Comparative Example 1 | Warpage Occurred in Module |
| Comparative Example 2 | Cracks were Developed |

The thermal conductivity, Young's modulus, density and coefficient of thermal expansion of the film were measured by known typical methods as measurement of physical values. Specifically, the respective methods of measuring Young's modulus, density and coefficient of thermal expansion are ultrasonic wave method, Archimedean method and thermo-mechanical analysis. The results are shown in Table 4. Note that the values of Al and the values of Cu are also shown in Table 4.

TABLE 4

| | Example 1 | Example 2 | Example 4 | Comparative Example 1 | Comparative Example 2 | Cu—Mo | Al | Cu |
|---|---|---|---|---|---|---|---|---|
| Thermal Conductivity (w/mk) | 162 | 149 | 195 | 204 | 375 | 211 | 230 | 398 |
| Young's Modulus (GPa) | 7.6 | 8.3 | 15 | 41 | 78 | 232 | 69 | 125 |
| Density ($g/cm^3$) | 2.2 | 2.1 | 6.5 | 2.6 | 8.7 | 9.3 | 2.7 | 8.9 |
| Coefficient of Thermal Expansion ($\times 10^{-6}/K$) | 12 | 13 | 12 | 17 | 16.5 | 8.5 | 24 | 16.6 |

As a result of observation by a microscope, as shown in FIG. 4 and Table 2, each of the films of Examples 1 to 3 contains carbon particles, and each of the films of Comparative examples 1 and 2 contains no carbon particles. As shown in Table 2, the percentage of graphite area of each of the films of Examples 1 and 2 is higher than the percentage of graphite area of the film of Example 3. Although not shown in FIG. 4 or Table 2, it was also identified that the film of Example 4 also contains carbon particles and has the percentage of graphite area substantially equal to that of Example 1.

It is presumable that, in Examples 1 to 4, film deposition powder was slurried using water, so moisture penetrating into the surface and inside of the carbon particles prevented graphite from being burned. In addition, the spheroidized graphite particles of Examples 1, 2 and 4 are presumably hard to be burned as compared with flaky graphite particles.

According to the results of heat transfer evaluation shown in FIG. 7, each of the modules of Examples 1, 2 and 4 is higher in heat radiation property than Cu—Mo material. In addition, each of the modules of Comparative examples 1 and 2 is slightly higher in heat radiation property than that of each of Examples 1, 2 and 4.

According to the results of heat-resistance evaluation, in the modules of Examples 1, 2 and 4, even when the number of cycles increases, there is almost no increase in the surface temperature of the aluminum nitride material; whereas, in the modules of Comparative examples 1 and 2, as the number of cycles increases, there is an increase in the surface temperature of the aluminum nitride material. In addition, as shown in Table 3, in any of the modules that uses Cu—Mo material and the modules of Examples 1, 2 and 4, the brazed layer or the solder layer has no abnormality.

The module of Comparative example 1 is larger than the others because the components are warped. Because of the warpage, when the module of Comparative example 1 is not brazed but soldered, it is presumable that solder develops cracks.

In addition, the module of Comparative example 2 has cracks in the solder layer. This is presumably because, in the case of Comparative example 2, the film contains no carbon particles. That is, as shown in Table 4, the coefficient of thermal expansion of Comparative example 2 is higher than those of Examples 1, 2 and 4, so it is presumable that the solder layer of Comparative example 2 developed cracks because of stress due to a difference in thermal expansion between the aluminum nitride material and the copper film made of copper only. As a result, it is presumable that cracks of the solder layer of Comparative example 2 progressed with an increase in the number of cycles, flow of heat was impaired by the progression of cracks, and the temperature of the surface of the aluminum nitride material increased with an increase in the number of cycles.

In this way, it is presumable that each of the films of Examples 1 to 4 is able to decrease its Young's modulus because the film contains graphite particles (carbon particles) and, therefore, thermal stress due to a difference in thermal expansion may be absorbed. Then, it may be understood that the thermal conductivity of each of the modules of Examples 1 to 4 is improved as compared with the module that uses Cu—Mo material, and, furthermore, it is advantageous in terms of heat-resistance cycle.

The above present embodiment will be described in outline below.

According to the present embodiment, a method of depositing a carbon particle-containing film that contains carbon particles includes: manufacturing film deposition slurry by mixing liquid into film deposition powder that contains carbon powder formed of the carbon particles; and depositing the carbon particle-containing film by spraying the film deposition slurry to a surface of a base material so that the liquid is vaporized.

In the above deposition method, the liquid may vaporize at or above a spraying temperature at which the film deposition slurry is sprayed to the surface of the base material.

With the above configuration, film deposition powder is mixed with liquid to manufacture film deposition slurry, so the liquid is uniformly added to the carbon particles of carbon powder contained in the film deposition slurry. Then, by spraying the film deposition slurry at the spraying temperature, the liquid contained in the slurry vaporizes on the surface of the base material at the latest, so the carbon particles are hard to be burned and accumulate on the surface of the base material. As a result, it is possible to deposit a carbon particle-containing film at low cost as compared with the related art. In addition, when the film deposition powder is formed of carbon powder, a film made of the carbon particles only may be deposited. In addition, so far, when a metal film that contains carbon particles is deposited, the metal material is limited to a metal material that can coat carbon particles. However, according to the above film deposition method, a metal material, such as aluminum, that is hard to coat carbon particles may also be easily deposited.

In the deposition method according to the present embodiment, the liquid may be water or alcohol. With the above configuration, water or alcohol is easily slurried with film deposition powder, so it is possible to deposit a film at low cost without leaving the liquid in the film.

In the deposition method according to the present embodiment, the film deposition powder may contain powder formed of metal.

With the above configuration, metal powder (metal particles) may be thermally sprayed to the base material. Then, by making the film deposition powder contain metal powder, it is possible to improve the thermal conductivity and electrical conductivity of the film, and the metal of the metal powder serves as a binder that binds the particles of the carbon powder in the film. Furthermore, the metal powder is superior in thermal conductivity than the other materials, and the film contains carbon particles. Thus, the Young's modulus of the deposited film may be lower than the Young's modulus of the film made of metal. As a result, when the film is arranged between the insulating member and heat sink member of a power module, which will be described later, the film operates as a stress buffering material that is excellent in heat-resistance cycle.

In the deposition method according to the present embodiment, the metal powder may be powder of copper or aluminum. With the above configuration, by using such metal powder. it is possible to improve not only the thermal conductivity of the film but also the electrical conductivity of the film.

In the deposition method according to the present embodiment, the carbon particles may be spheroidal. With the above configuration, the carbon particles are hard to be burned during film deposition, and it is possible to efficiently make the film contain the carbon particles.

A heat transfer member in which the carbon particle-containing film is deposited on a surface of a base material may be manufactured by the above deposition method. The heat transfer member may be included in a power module that includes a power device and an insulating member on which the power device is mounted on a side opposite to a side on which the heat transfer member is provided, the base material may function as a heat sink member, and the carbon particle-containing film may be arranged between the insulating member and the base material.

With the above configuration, the carbon particle-containing film of the heat transfer member is arranged between the insulating member and heat sink member that constitute the power module. Thus, the power module is not required to use silicon grease for blocking thermal conduction on the surface of the heat sink member. The power module is able to efficiently transfer heat from the heated power device by the heat sink member. Furthermore, the carbon particle-containing film contains the carbon particles, so, as described above, it is possible to buffer a difference in thermal expansion between the insulating member and the heat sink member. As a result, it is possible to obtain the reliable power module that prevents peeling or cracks of the film to improve fatigue strength against heat cycle.

The power module may be used for a vehicle inverter.

In the present embodiment, water or alcohol is used as the liquid. Instead, the liquid is not specifically limited as long as liquid satisfies two conditions that the liquid vaporizes at the spraying temperature at which the film deposition slurry is sprayed to the surface of the base material and, when liquid is mixed with film deposition powder, the liquid does not react with the powder, and the powder and the liquid do not separate from each other to form slurry. For example, neutral liquid, such as water, alcohol, ether and acetone, may be used.

In addition, powder contained in the film deposition powder together with carbon powder may be powder, such as resin powder and ceramic powder, other than metal powder.

In the present embodiment, gas-atomized powder is used as metal powder; however, a method of manufacturing metal powder is not specifically limited. For example, water-atomized powder, electrolytic powder or granulated powder granulated from these types of powder may be used as metal powder.

In addition, the carbon particles used in the deposition method according to the present embodiment may be graphite particles or carbon black particles.

In the present embodiment, a method of spheroidizing carbon particles may be, for example, a chemical manufacturing method in which PMMA (polymethyl methacrylate)/PDVB (polydivinylbenzene) are polymerized and then carbonized, and a method in which flaky particles are mechanically bent into a spheroidal shape. As long as the carbon particles may be manufactured into a spheroidal shape, the manufacturing method is not specifically limited.

In addition, a heat transfer member manufactured according to the above deposition method has a high thermal conductivity. Thus, the heat transfer member may be, for example, used for devices that include a heat radiation structure, such as engine components of a vehicle and a CPU of an electronic device.

The base material of the heat transfer member may be, for example, used as a heat sink of a computer, an audio instrument, and the like. Specifically, the film may be deposited on a portion of the surface of the heat sink, bonded on a side at which a heat generating element is provided. In addition, the film may be, for example, deposited on a contact portion of electrical components, a bonding portion between metals of different types, or the like, using the deposition method.

For example, copper powder is used in the present embodiment; however, it is not limited. Powder of copper alloy, powder of any one of chromium, nickel or iron, or powder of alloy of these metals may be used. In addition, the base material is made of aluminum. However, as long as the adhesion of the film may be ensured, the material of the base material is not specifically limited.

In addition, in the present embodiment, film deposition is performed by HVOF thermal spraying. However, as long as the film may be formed, film deposition may be performed by thermal spraying using electricity, such as arc thermal spraying and plasma thermal spraying, or gas thermal spraying, such as powder flame spraying and detonation flame spraying, or film deposition may be performed by cold spraying.

In addition, in the deposition method according to the present embodiment, the method of manufacturing a power module is described. Instead, for example, the deposition method may be used to deposit an ablatable thermally sprayed film that is easily ablatable by the other material, as in the case of a portion, facing an impeller, of a compressor housing of a turbocharger for an automobile.

A component deposited by the deposition method according to the aspect of the invention has a high thermal conductivity, so the component may be applied to the heat transfer member. In addition, the deposition method may be applied when a film is deposited on a portion that requires heat radiation property under strict thermal environment, such as an engine component, a CPU of a computer, an audio instrument for a vehicle, and a household electric appliance. In addition, the deposition method may be applied to an ablatable thermal spraying film of a compressor housing of a turbocharger for an automobile.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

What is claimed is:

1. A method of depositing a carbon particle-containing film that contains carbon particles, comprising:

manufacturing film deposition slurry by mixing liquid into film deposition powder that contains carbon powder formed of graphite particles such that the liquid penetrates into the surface and inside of the graphite particles; and depositing the carbon particle-containing film by spraying the film deposition slurry to a surface of a base material so that the liquid is vaporized at a temperature at which the film deposition slurry has reached the surface of the base material, wherein the temperature at which the film deposition slurry has reached the surface of the base material is provided by a flame having a temperature of 1500° C. to 2000° C., wherein the liquid is water or alcohol and the graphite particles are spheroidal.

2. The method according to claim 1, wherein the liquid vaporizes at or above a spraying temperature at which the film deposition slurry is sprayed to the surface of the base material.

3. The method according to claim 1, wherein the film deposition powder contains powder formed of metal.

4. The method according to claim 3, wherein the film deposition slurry is sprayed to the surface of the base material at a temperature at which the powder formed of metal is thermally sprayed.

5. The method according to claim 3, wherein the metal is copper or aluminum.

* * * * *